US008004379B2

(12) United States Patent
Hansen

(10) Patent No.: US 8,004,379 B2
(45) Date of Patent: Aug. 23, 2011

(54) HIGH POWERED INDUCTORS USING A MAGNETIC BIAS

(75) Inventor: Thomas T. Hansen, Yankton, SD (US)

(73) Assignee: Vishay Dale Electronics, Inc., Columbus, NE (US)

( * ) Notice: Subject to any disclaimer, the term of this patent is extended or adjusted under 35 U.S.C. 154(b) by 48 days.

(21) Appl. No.: 12/134,240

(22) Filed: Jun. 6, 2008

(65) Prior Publication Data

US 2009/0066454 A1 Mar. 12, 2009

Related U.S. Application Data

(60) Provisional application No. 60/970,578, filed on Sep. 7, 2007.

(51) Int. Cl.

| | |
|---|---|
| ***H01F 30/14*** | (2006.01) |
| ***H01F 27/02*** | (2006.01) |
| ***H01F 21/00*** | (2006.01) |
| ***H01F 17/06*** | (2006.01) |
| ***H01F 17/04*** | (2006.01) |
| ***H01F 27/28*** | (2006.01) |
| ***H01F 7/06*** | (2006.01) |

(52) U.S. Cl. ..... 336/10; 336/83; 336/110; 336/178; 336/221; 336/222; 336/223; 29/606

(58) Field of Classification Search ..... None
See application file for complete search history.

(56) References Cited

U.S. PATENT DOCUMENTS

| | | | | |
|---|---|---|---|---|
| 5,719,546 | A * | 2/1998 | Ito et al. | 336/180 |
| 6,392,525 | B1 | 5/2002 | Kato et al. | |
| 6,590,485 | B2 * | 7/2003 | Fujiwara et al. | 336/83 |
| 2001/0016977 | A1 * | 8/2001 | Moro et al. | 29/606 |
| 2001/0052838 | A1 * | 12/2001 | Hamanaka et al. | 336/200 |
| 2002/0017971 | A1 * | 2/2002 | Koyama et al. | 336/83 |
| 2004/0113741 | A1 * | 6/2004 | Li et al. | 336/212 |
| 2004/0207500 | A1 | 10/2004 | Fujiwara et al. | |
| 2005/0212643 | A1 | 9/2005 | Kuroiwa et al. | |
| 2006/0280921 | A1 * | 12/2006 | Oh et al. | 428/212 |
| 2007/0252669 | A1 * | 11/2007 | Hansen et al. | 336/212 |
| 2008/0012674 | A1 * | 1/2008 | Sano et al. | 336/83 |
| 2008/0074225 | A1 | 3/2008 | Hansen et al. | |

FOREIGN PATENT DOCUMENTS

EP 1225601 A 7/2002

(Continued)

OTHER PUBLICATIONS

Dec. 16, 2009 International Preliminary Report on Patentability—related PCT Application No. US2008/066305.

(Continued)

*Primary Examiner* — Anh T Mai
*Assistant Examiner* — Mangtin Lian
(74) *Attorney, Agent, or Firm* — Volpe and Koenig, P.C.

(57) ABSTRACT

A biased gap inductor includes a first ferromagnetic plate, a second ferromagnetic plate, a conductor sandwiched between the first ferromagnetic plate and the second ferromagnetic plate, and an adhesive between the first ferromagnetic plate and the second ferromagnetic plate, the adhesive comprising magnet powder to thereby form at least one magnetic gap. A method of forming an inductor includes providing a first ferromagnetic plate and a second ferromagnetic plate and a conductor, placing the conductor between the first ferromagnetic plate and the second ferromagnetic plate, adhering the first ferromagnetic plate to the second ferromagnetic plate with a composition comprising an adhesive and a magnet powder to form magnetic gaps, and magnetizing the inductor.

14 Claims, 3 Drawing Sheets

FOREIGN PATENT DOCUMENTS

| | | | | |
|---|---|---|---|---|
| EP | 1286371 | A | | 2/2003 |
| JP | 07283046 | A | | 10/1995 |
| JP | 2002-222707 | A | * | 8/2002 |
| JP | 2002222707 | A | | 8/2002 |
| WO | 9705632 | A | | 2/1997 |

OTHER PUBLICATIONS

English Machine Translation of JP 200222707 obtained from Japanese Patent Office website, Aug. 9, 2002.

* cited by examiner

HIGH POWERED INDUCTORS USING A MAGNETIC BIAS

CROSS-REFERENCE TO RELATED APPLICATIONS

This application claims priority under 35 U.S.C. §119 to provisional application Ser. No. 60/970,578 filed Sep. 7, 2007, herein incorporated by reference in its entirety.

BACKGROUND OF THE INVENTION

Low profile inductors, commonly defined as inductors having a profile less than about 10 mm are in existence today in the form of ferrites with unique geometries and pressed iron powder around a wound coil. Ferrite based low profile inductors have an inherent limitation of magnetic saturation at relatively low levels of current. When magnetic saturation occurs, inductance value decreases dramatically.

Pressed iron inductors allow for much higher input current than ferrite inductors, but have the limitation of producing high core losses at high frequencies (such as frequencies greater than 200 kHz). What is needed is an efficient means to provide inductance at high frequencies allowing high input currents.

It is therefore a primary, object, feature, or advantage of the present invention to improve upon the state of the art.

It is a further object, feature, or advantage of the present invention to provide an inductor which has lower core losses at high ripple currents (>5 A) and frequencies (>200 kHz) in a thin package yet also have the high saturation current performance of powdered iron.

Another object, feature, or advantage of the present invention is to use adhesive film thickness or magnet particle size to adjust inductance characteristics.

A further object, feature, or advantage of the present invention is to increase the capability of an inductor to effectively handle more DC while maintaining inductance.

One or more of these and/or other objects, features, or advantages of the present invention will become apparent from the description of the invention that follows.

BRIEF SUMMARY OF THE INVENTION

According to one aspect of the present invention, a biased gap inductor includes a first ferromagnetic plate, a second ferromagnetic plate, a conductor sandwiched between the first ferromagnetic plate and the second ferromagnetic plate, and an adhesive between the first ferromagnetic plate and the second ferromagnetic plate, the adhesive comprising magnetically hard magnet powder to thereby form at least one magnetic gap. The adhesive has a thickness of less than 500 um and preferably less than 100 um. The magnetic powder size can be used to set the inductance level of the part. Also the amount of magnet powder can modify characteristics of the part to produce a desired performance.

According to another aspect of the present invention, a method of forming an inductor includes providing a first ferromagnetic plate and a second ferromagnetic plate and a conductor, placing the conductor between the first ferromagnetic plate and the second ferromagnetic plate, adhering the first ferromagnetic plate to the second ferromagnetic plate with a composition comprising an adhesive and a magnet powder to form magnetic gaps, and magnetizing the inductor. The composition has a thickness of less than 500 um and preferably less than 100 um.

According to another aspect of the present invention, a biased gap inductor is provided. The inductor includes a first ferromagnetic plate and a second ferromagnetic plate. A conductor is sandwiched between the first ferromagnetic plate and the second ferromagnetic plate. A magnetic material having a thickness of less than 100 um is between the first ferromagnetic plate and the second ferromagnetic plate to from at least one magnetic gap. The thickness may be used to define inductance characteristics of the inductor.

DETAILED DESCRIPTION OF THE PREFERRED EMBODIMENT

Figure 1:
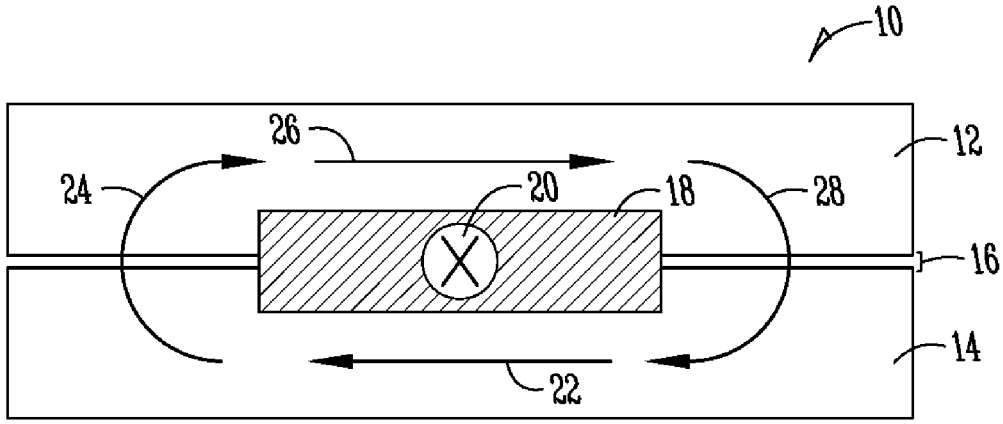
Fig.1 (PRIOR ART)
FIG. 1 is a cross-section of a prior art inductor without flux channeling.

FIG. 1 illustrates a prior art device where a single strip of copper can be placed between two ferrite parts to create an inductor. While this is effective in creating low value, high frequency inductors, it limits the amount of input current the inductor can handle without saturating. The primary cause of saturation comes from the fact that all magnetic flux induced by the copper flows through narrow cross-sectional areas. FIG. 1 illustrates the flux pattern in a single copper strip inductor. In FIG. 1, an inductor 10 has a first ferromagnetic plate 12 and a second ferromagnetic plate 14. There is a spacing 16 between the first ferromagnetic plate 12 and the second ferromagnetic plate 14. The magnetic flux induced by a current through the single strip copper conductor 18 is split between each plate 12, 14. Input current 20 is shown using notation to indicate that the current is flowing into the page. Arrows 22, 24, 26, 28 indicate the direction of magnetic flux induced by the current 20 through the conductor 18. Note that all the magnetic flux induced by the current in the copper conductor 18 flows through narrow cross-sectional 22, 26 areas thereby becoming the primary cause of saturation.

Figure 2:
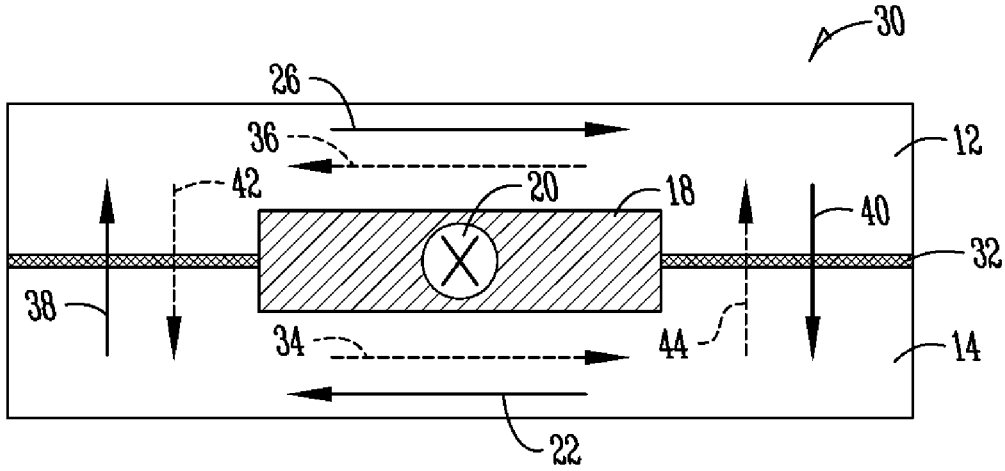
FIG. 2 is a cross-section of one embodiment of a flux-channeled inductor of the present invention.

The present invention provides a low cost method which enables inductors to extend their operating range up to a factor of two. The invention introduces adhesive filled with magnet powder in the gaps between ferromagnetic pieces. FIG. 2 illustrates one embodiment of the present invention. An inductor 30 is shown which is formed from a first ferromagnetic plate 12 and a second ferromagnetic plate 14. The first ferromagnetic plate 12 and the second ferromagnetic plate 14 are mechanically bonded through a composition 32 which includes an adhesive and a magnet powder. Arrows 22, 26, 38, 40 indicate the direction of magnetic flux induced by the current 20 through the conductor 18. Arrows 34, 36, 42, 44 indicate the direction of magnet induced "counter" flux.

The composition 32 may be comprised of epoxy and magnet powder mixed in predetermined ratios. The use of the adhesive with the magnet powder has a dual role in the assembly of an inductive component. Varying the size of the magnet particulate raises or lowers the inductance of the part. Small magnet powder size creates a thin gap inductor with a high inductance level. A large magnet powder increases the gap size resulting in a reduced inductance of a part. Thus, the magnet powder particulate size can be selected to tailor the inductance of a part for a specific application. In other words, the magnet powder size can be used to set the inductance level of the part. Also, the amount of magnet powder used can modify characteristics of the part to produce a desired performance. The second role of the adhesive is to permanently bind the parts together making the assembly robust to mechanical loads. In a preferred embodiment, the thickness of the magnet particulate layer is between about 0 to 100 um. Larger magnetic bias thickness of between about 0 and 500 um may also be used.

The magnet powder can consist of a spherical or irregular shaped material. Ceramic magnet powders can be used as the magnet powder. The preferred materials are spherical rare earth magnetic material such as, but not limited to, Neodymium-Iron-Boron or Samarium-Cobalt magnet powder. One reason is that spherical particulate is more consistent at achieving specific distances between plates. The second reason is rare earth magnets have sufficiently high intrinsic coercive forces to resist demagnetization in application.

Ferromagnetic plates can be made from a magnetically soft material such as, without limitation, ferrite, molypermalloy (MPP), Sendust, Hi Flux, or pressed iron. Although other materials may be used, a preferred material is ferrite as it has low core losses at high frequencies and is generally less expensive than alternatives. Ferrite has low magnetic saturation resistance and thus benefits from introducing a magnetic bias.

The present invention provides for adding magnet powder filled adhesive between ferromagnetic plates. Once the adhesive is fully cured, the component is magnetized such that the magnetic material applies a steady state magnetic flux field that opposes the direction induced from a current carrying inductor.

Figure 3:
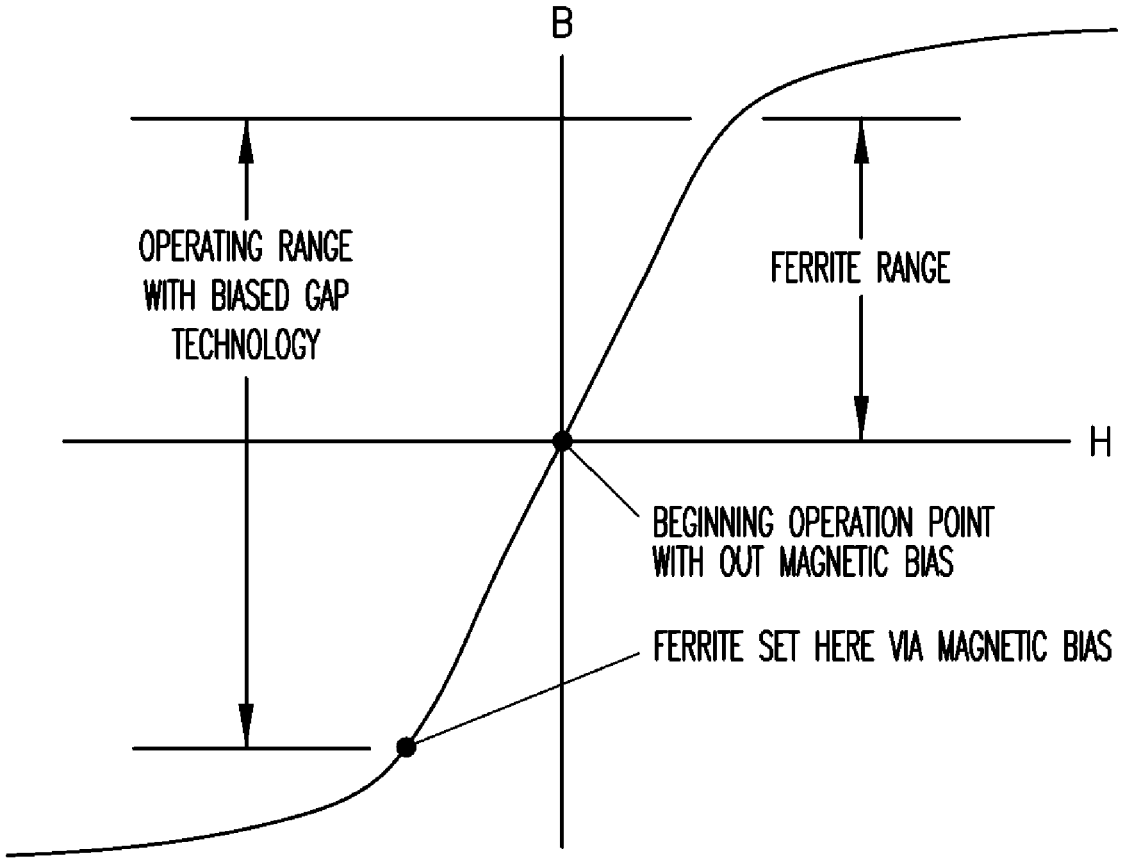
FIG. 3 illustrates a relationship between DC voltage and a BH-loop and how operation range is increased with the biased gap.

FIG. 2 illustrates the static magnetic flux and the induced magnetic flux from the conductor. FIG. 3 is a hypothetical B-H loop of soft ferromagnetic ferrite plates. At zero input DC into the conductor, the ferromagnetic material is polarized or biased such that its flux field is near the maximum negative saturation point. When DC is applied, this negative flux field gradually decreases until the magnetic flux density in the ferromagnetic material is zero. Upon further increase in DC, the magnetic flux field begins to go positive until magnetic saturation occurs. Introducing magnetic material in the gap thus increases the ferromagnetic material's ability to withstand saturation thereby significantly increasing its range, such as by two times.

Figure 4:
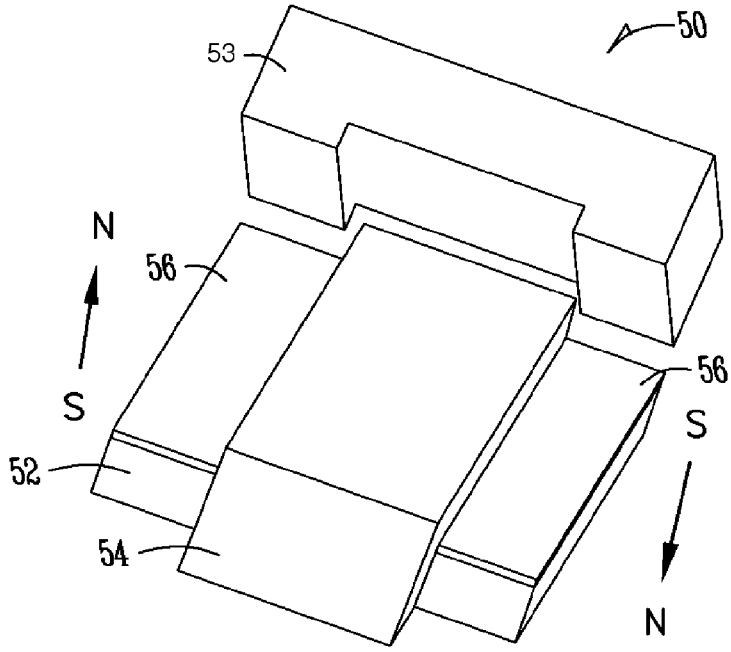
FIG. 4 illustrates a single conductor inductor with two magnetic gaps.

FIG. 4 is a perspective view of a single conductor inductor 50 with two magnetic gaps. In FIG. 4, two ferromagnetic plates 52, 53 are combined together by a distance set by the size of the magnetic particulate. A conductor 54 is disposed between the two ferromagnetic plates 52, 53. A mixture of magnet powder and epoxy forms the composition 56 which may be screen printed onto one of the sides of the ferromagnetic plates, ferromagnetic plate 52 as shown in FIG. 4. A magnetic gap is created in each region where the composition 56 is applied. A second ferromagnetic plate 53 is placed upon the first and the adhesive is heat cured to permanently bond the assembly together. Once the parts are cured, they are then magnetized. FIG. 4 illustrates the polarity of the magnetic material such that the subsequent flux field between the two ferromagnetic plates adds to each others' magnetic flux direction. The polarity of the magnet induced flux is set in the opposite direction to any magnetic induced flux caused from direct current input into the conductor.

Figure 5:
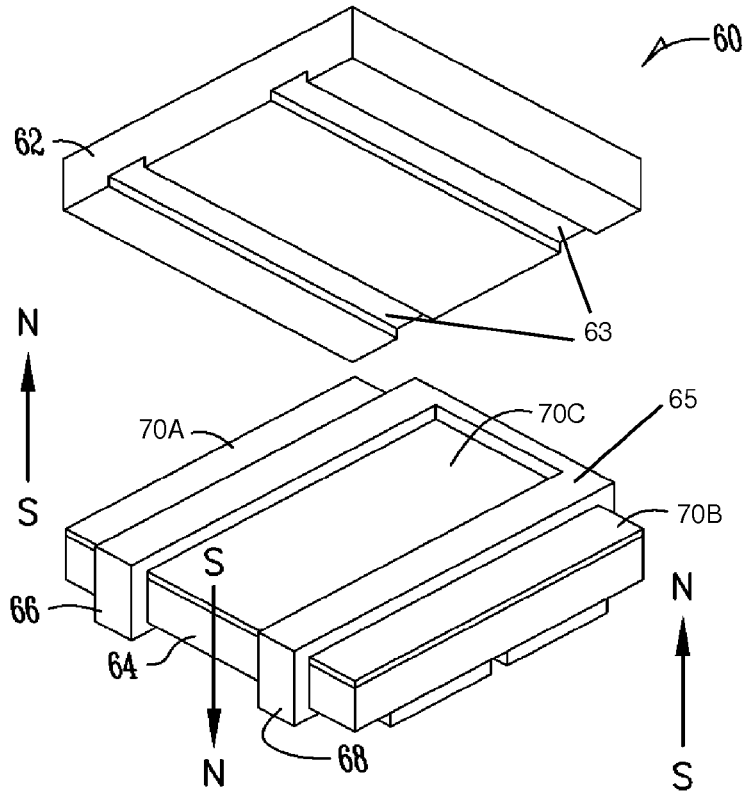
FIG. 5 is a perspective view of a multi-poled configuration of an inductor.

FIG. 5 is a perspective view of one embodiment where there are three magnetic gaps, each of the magnetic gaps formed for a mixture containing magnet powder and preferably an adhesive such as epoxy. The mixture can be deposited by screen printing and can be considered a magnetic film as it includes a magnet powder is applied in three separate places, 70A, 70B, 70C. The configuration shown in a multi-poled configuration. The outside magnetic films 70A, 70B are polarized in the same direction while the center 70C is polarized in an opposite direction. This is performed in order to form a magnetic field that will be additive for all three magnetic films. The inductor 60 include a first ferromagnetic plate 62 and a second ferromagnetic plate 64. There are grooves 63 cut in ferromagnetic plate 62. The grooves 63 extend from one side of the ferromagnetic plate 62 to an opposite side of the ferromagnetic plate 62. A conductor 65 is shown. The conductor 65, which includes segments 66, 68 on the side of the second ferromagnetic plate 64 is bent around the second ferromagnetic plate 64 to form three surfaces 70A, 70B, 70C upon each of which the magnetic film is adhered. After the ferromagnetic plates 62, 64 are placed together, the adhesive may be heat cured, then device 60 may be magnetized. FIG. 5 provides a multi-poled configuration as the outside magnetic films are polarized in the same direction while the center is polarized in an opposite direction. This is done to form a magnetic field that will be additive for all three magnetic films. The polarity of the magnet induced flux is set in the opposite direction to any magnetic induced flux caused from direct current input into the conductor.

Thus, it should be apparent that the present invention provides for improved inductors and methods of manufacturing the same. The present invention contemplates numerous variations in the types of materials used, manufacturing techniques applied, and other variations which are within the spirit and scope of the invention.

What is claimed is:

1. A biased gap inductor, comprising:

a first ferromagnetic plate;

a second ferromagnetic plate;

a conductor sandwiched between the first ferromagnetic plate and the second ferromagnetic plate and bent around a front surface of the second ferromagnetic plate downwardly towards a bottom surface of the second ferromagnetic plate; and an adhesive between the first ferromagnetic plate and the second ferromagnetic plate, the adhesive comprising magnet powder to thereby form a first magnetic gap and a second magnetic gap on opposite sides of the conductor, the adhesive binding together the first and second ferromagnetic plates, the adhesive having a thickness of less than 500 um;

wherein the adhesive is magnetized such that the magnet powder applies a steady state magnetic flux and the first magnetic gap is polarized in an opposite direction from the second magnetic gap.

2. The biased gap inductor of claim 1 wherein the adhesive is epoxy.

3. The biased gap inductor of claim 1 wherein the magnet powder comprises spherical rare earth magnetic particulate.

4. The biased gap inductor of claim 3 wherein the spherical rare earth magnetic particulate comprises a neodymium-iron-boron alloy.

5. The biased gap inductor of claim 3 wherein the spherical rare earth magnetic particulate comprises a samarium-cobalt alloy.

6. The biased gap inductor of claim 1 wherein each of the first ferromagnetic plate and the second ferromagnetic plate comprises ferrite.

7. The biased gap inductor of claim 1 wherein the conductor comprises copper.

8. The biased gap inductor of claim 1 wherein the conductor is configured in a multiple loop configuration.

9. The biased gap inductor of claim 1 wherein the thickness of the adhesive is used to define inductance characteristics of the inductor.

10. The biased gap inductor of claim 1 wherein the thickness is less than 100 um.

11. A biased gap inductor, comprising:

a first ferromagnetic plate;

a second ferromagnetic plate;

a conductor sandwiched between the first ferromagnetic plate and the second ferromagnetic plate and bent around a front surface of the second ferromagnetic plate downwardly towards a bottom surface of the second ferromagnetic plate;

a magnetic material having a thickness of less than 100 um between the first ferromagnetic plate and the second ferromagnetic plate to form two magnetic gaps on opposite sides of the conductor polarized in opposite directions and apply a steady state magnetic flux, the magnetic material having an adhesive binding together the first and second ferromagnetic plates, the thickness of the magnetic material defining inductance characteristics of the inductor.

12. A biased gap inductor, comprising:

a first ferromagnetic plate;

a second ferromagnetic plate;

the first ferromagnetic plate having a groove to receive a conductor sandwiched between the first ferromagnetic plate and the second ferromagnetic plate, the conductor being bent around a front surface of the second ferromagnetic plate downwardly towards a bottom surface of the second ferromagnetic plate;

an adhesive between the first ferromagnetic plate and the second ferromagnetic plate, the adhesive comprising magnet powder to thereby form three magnetic gaps separated by the conductor, the adhesive binding together the first and second ferromagnetic plates, the adhesive having a thickness of less than 500 um; and the three magnetic gaps being polarized in alternating directions.

13. The biased gap inductor of claim 12 wherein the thickness of the adhesive is less than 100 um.

14. The biased gap inductor of claim 12 wherein the conductor is bent around the bottom surface of the second ferromagnetic plate.

* * * * *